US005857580A

United States Patent [19]

Iidaka

[11] Patent Number: 5,857,580

[45] Date of Patent: Jan. 12, 1999

[54] BOTTLE AND CLOSURE WITH SEPARABLE CAP AND PLUG ELEMENTS

[75] Inventor: Tsuguo Iidaka, Sukagawa, Japan

[73] Assignee: Sanshu Corporation, Japan

[21] Appl. No.: 708,570

[22] Filed: Sep. 5, 1996

[30] Foreign Application Priority Data

Sep. 6, 1995 [JP] Japan ..... 7-229159

[51] Int. Cl.[6] ..... B65D 39/04

[52] U.S. Cl. ..... 215/256; 215/250; 215/354; 215/355; 215/320; 220/276

[58] Field of Search ..... 215/250, 251, 215/253, 254, 256, 40, 43, 46, 901, 296, 320, 354–356, 341, 343, 345; 220/266, 269, 276

[56] References Cited

U.S. PATENT DOCUMENTS 3,924,771 12/1975 Cleff ..... 215/256 X

*Primary Examiner*—Stephen K. Cronin
*Assistant Examiner*—Robin A. Hylton
*Attorney, Agent, or Firm*—Lorusso & Loud

[57] ABSTRACT

A closure for a beverage bottle includes a plug element having a disk shaped head portion and a hollow cylindrical portion which seals with the inner surface of the opening of the bottle. An annular projection is formed around the circumference of the bottle 12 near its mouth. The closure further includes a cap element which fits over the plug element and which includes with a skirt having an annular recess which locks onto the annular projection of the bottle. A first precut line is provided in the cap, extending around its circumference and a second precut line portion extends from the distal edge of the skirt to the first precut line across the annular recess. The cap may be disengaged from the bottle by cutting through the second precut line and the first precut line.

14 Claims, 6 Drawing Sheets

BOTTLE AND CLOSURE WITH SEPARABLE CAP AND PLUG ELEMENTS

BACKGROUND OF THE INVENTION

The present invention relates to a cap/plug closure for sealably closing the opening of a bottle.

When a bottle containing a beverage "carbonated" with carbon dioxide gas or other dissolved gas has its temperature raised or when it is moved about in a user's hand, the internal pressure within the bottle may be elevated, causing a plug closing the mouth of the bottle to become disengaged with the result that the carbon dioxide or other gas dissolved in the beverage escapes. To prevent such an accident, an external annular protrusion (hereinafter "rib") is formed at a position in the vicinity of the mouth of the bottle, e.g. a bottle for a champagne or the like, and a wire is wrapped around the neck of the bottle below the rib and around the plug to retain the plug within the bottle.

In the case of a wine, a portion of the bottle, including the mouth sealed with a plug and a part of the neck, is covered with a metallic cap.

The above type seal presents the danger that a user's finger may be injured by the wire when the latter is disengaged from the bottle. In addition, in packaging, since the placing of the wire on the neck of the bottle is by hand, assembly is time-consuming and expensive.

With a bottle having its mouth and plug covered with a metallic cap, there is the danger that a user's finger may be injured by the metallic cap when the latter is disengaged or removed from the bottle. Additionally, since the mouth of the bottle is closed with a metallic cap, the cost of the bottle is increased and, moreover, the metallic cap represents a waste injurious to the environment.

SUMMARY OF THE INVENTION

The present invention represents a solution to the above-described problems.

More specifically, an object of the present invention is to provide a closure for sealably closing the mouth of a bottle which obviates the need for a conventional wire wrap over the mouth of the bottle and, moreover, the potential for injury of the end user's finger posed by the wire and the metallic cap of the prior art.

Accordingly, in one aspect of the present invention, there is provided a closure for sealably closing the mouth of a bottle with a plug wherein first engaging means is provided on the bottle adjacent its mouth and second engaging means is provided on the closure for engaging the first engaging means. The closure includes a plug element having a head portion and a cylindrical portion, integral with the head portion, for insertion into the mouth of the bottle and forming a seal therewith, and a cap element carrying the second engagement means and sealing with the plug element when fitted over the mouth of the bottle. The cap element includes a skirt portion having a circumferential cut or cuts therein defining a cutting line along which the cap element may be broken to open the bottle.

Other objects, features and advantages of the present invention will become apparent from a reading of the following description in conjunction with the accompanying drawings.

BRIEF DESCRIPTION THE DRAWINGS

DESCRIPTION OF THE PREFERRED EMBODIMENTS

The present invention will now be described in more detail with reference to the accompanying drawings which illustrate preferred embodiments thereof.

Figure 1:
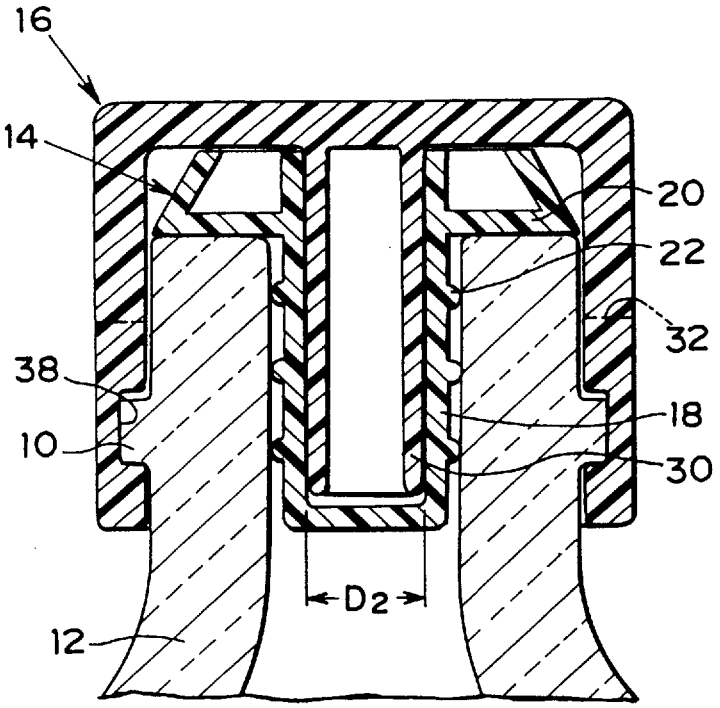
FIG. 1 is a vertical cross-sectional view of a cap and plug closure for sealably closing the mouth of a bottle in accordance with a first preferred embodiment of the present invention.

As shown in FIG. 1, according to the present invention, a bottle 12 has an annular projection (rib) 10 formed around its outer circumference adjacent the mouth to serve as first engaging means. The mouth of the bottle 12 is sealably closed with a plug 14 and a cap 16 is placed over the mouth of the bottle 12, forming a seal with the plug 14.

Figure 2:
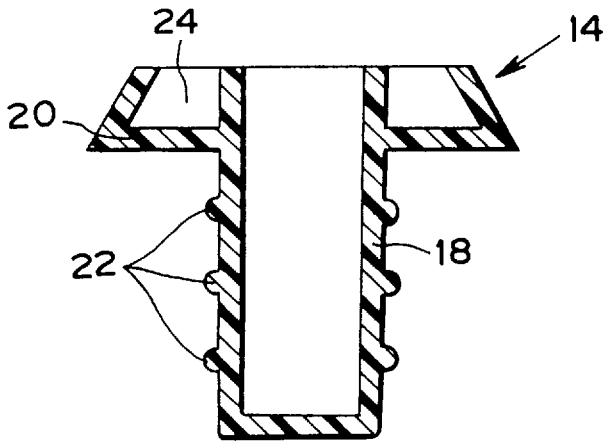
FIG. 2 is a vertical sectional view of the plug element of the closure of FIG. 1.

As shown in FIG. 2, the plug element 14 is molded of a flexible synthetic resin material and includes a cylindrical portion 18 having a distal end (lower end) which is closed and an opposite end which is open. The plug 14 further includes a head portion 20 integral with the cylindrical portion 18. A plurality of annular protrusions 22 are formed around the circumference of the outer surface of the cylindrical portion 18 for sealing with the inner wall of the neck of the bottle 12. The outer diameter of each of the annular protrusions 22 is dimensioned to be slightly larger than the inner diameter of the neck of the bottle 12.

As seen in FIG. 2, a hollow 24 is formed in the head portion 20 open on the same side as the open end of the cylindrical portion 18. The hollow portion 24 is provided to allow for easy removal of the plug 14 from a molding die, to minimize the quantity of molding material and cost thereof and to make the head portion 20 more pliable.

Figure 3:
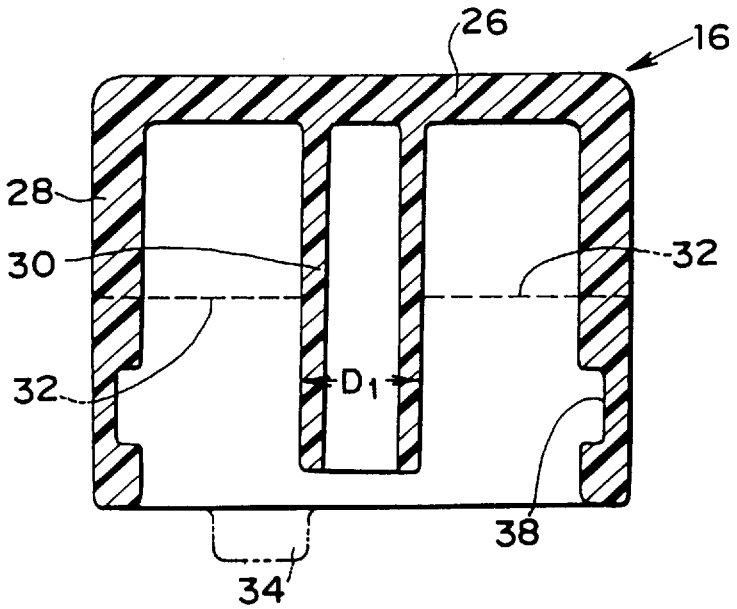
FIG. 3 is a vertical sectional view of the cap element of the closure of FIG. 1.

As shown in FIG. 3, the cap element 16 includes top portion 26 and an integral cylindrical sleeve or skirt 28, one end of which is closed by the top portion 26 and the other end of which is open. The cylindrical skirt 28 is designed to extend beyond the annular projection 10 on the bottle. Also integral with and depending from the top portion 26, is a hollow cylindrical portion 30 which is concentric with the skirt 28, and which has one end closed by top portion 26 and an open distal end. It is preferred that the outer diameter $D_1$ of the cylindrical portion 30 be equal to or slightly larger than the smallest inner diameter $D_2$ (see FIG. 1) of the cylindrical portion 18 of the plug element 14.

Figure 4:
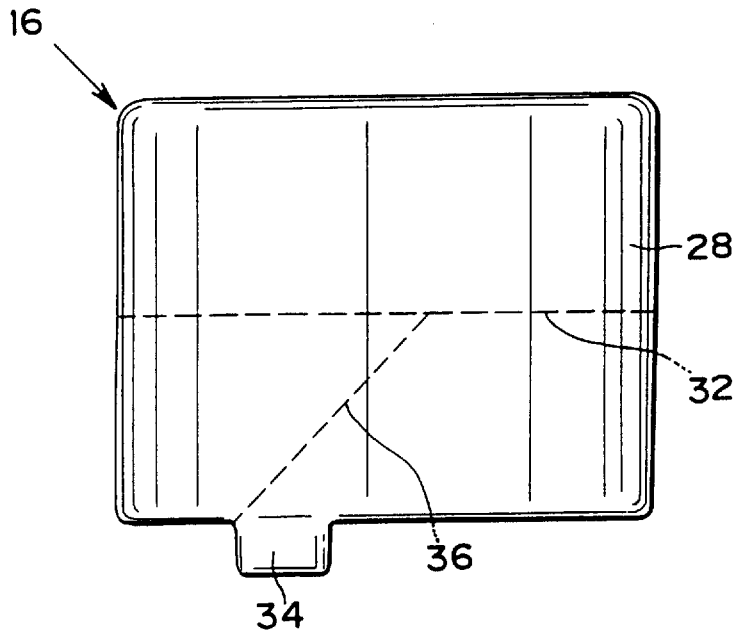
FIG. 4 is a side view of the cap element shown in FIG. 3.

As shown in FIG. 4, the skirt 28 of the cap element 16 includes a first precut line 32 of discontinuous cuts which extend around the circumference of the skirt 28 and, when broken along the first cutout line 32, the cap element 16 is separated into two ring-shaped parts. In addition, a grip 34 is formed integral with the skirt 28, extending downward from the lower edge of the skirt 28. A second cutout line 36 intersects the first cutout line 32 and extends from the first cutout line 32 to the free edge of the opening of the sleeve 28 in the vicinity of the grip 34. Both the first cutout line 32 and the second cutout line 36 are either serrated or are thin-walled to enable the cap element 16 to be broken by hand.

An annular recess 38 is formed on the inside of the skirt 28 to serve as a second engaging means. The annular recess 38 is designed to mate with (fit over) the annular projection (rib) 10 of the bottle 12. The annular recess 38 is designed so as not to allow disengagement even when the cap 16 is pulled with a normal user's strength applied thereto, without prior separation along the precut lines.

The annular recess 38 is formed closer to the edge of the skirt 28 than to the first precut line 32.

The second precut line 36 is intended to provide communication between the open end of the sleeve 28 and the first precut line 32 so that the annular recess 38 is cut vertically upon breaking the cap element 16.

To close the mouth of the bottle 12, first, the cylindrical portion 18 of the plug element 14 is inserted into the mouth of the bottle 12 until the head portion 20 of the plug 14 is brought into contact with the upper edge of the mouth of the bottle 12. At this time, because the outer diameter of each of the annular protrusions 22 is slightly larger than the inner diameter of the upper neck of the bottle 12 and because the plug 14 is molded of a flexible synthetic resin, the plural annular protrusions 22 on the outer wall of the cylindrical portion 18 of the plug 14 come in tight contact with the inner wall of the neck of the bottle 12 and they are compressed so that a liquid seal is formed to contain the liquid within the bottle 12.

Since the cylindrical portion 18 of the plug 14 is hollow, on occasion its inner diameter may be reduced when it is inserted into the mouth of the bottle 12. In such a case, even though this increases the difference between the inner diameter of the bottle 12 and the outer diameter of the cylindrical portion 18 of the plug 14 and/or between the inner diameter of the bottle 12 and the outer diameter of the annular protrusions 22, the elasticity of the annular protrusions 22 allows compensation for these dimensional changes and a liquid tight seal to be maintained. Insertion of the plug 14 into bottle 12 can be achieved automatically using a conventional machine.

Next, with the plug 14 fitted into the bottle 12, the cap 16 is placed on the bottle 12 covering the plug 14. At this time, the cylindrical portion 30 depending from the center of the head portion 26 of the cap 16 is (press) fitted into the inner cylindrical portion 18 of the plug 14. At this time, since the cap 16 is molded of a flexible synthetic resin, and moreover, because the cylinder portion 30 is hollow, the cylindrical portion 30 can be (press) fitted into the interior of the is cylindrical portion 18 of the plug 4 even though the outer diameter of the cylindrical portion 18 of the cap 16 is equal to or slightly larger than the minimum inner diameter of the cylindrical portion 18 of the plug 14.

By fitting the cylindrical portion 30 of the cap 16 into the inner hollow space of the cylindrical portion 18 of the plug 14 in the above-described manner, the cap 16 is firmly fixed to the plug 14. Thus, even when the pressure in the bottle 12 is increased, the cap 16 absorbs the force which would otherwise tend to disengage the plug 14 from the bottle 12.

When the cap 16 is fitted onto the bottle 12 and the plug 14, the annular recess 38 formed on the sleeve 28 is fitted onto the annular projection 10 of the bottle 12. Once this fitting is achieved, the lower edge of the annular recess 38 of the skirt 28 engages the annular lower edge of the annular protrusion 10 of the bottle 12 to prevent disengagement of the closure. The shape and dimensions of the annular recess 38 and of the sleeve 28 are determined such that the annular projection 10 of the bottle 12 cannot be disengaged from the annular recess 38 of the skirt 28 by pressure which might be generated within the bottle by a liquid such as champagne or the like.

Since the opening of the cylindrical portion 30 is effectively closed when fitted into the opening of the cylindrical portion 18 of the plug 14, the telescoping cylindrical portions 18 and 30 form a closed chamber therebetween when fitted together and the volume of this closed chamber is reduced, thus raising the pressure of the air within, as these two cylindrical portions telescope together in sealing the bottle. However, any force generated by the air pressure within this closed cylindrical chamber, tending to disengage the cap 16 is also borne by the annular projection 10 of the bottle 12 through engagement with the bottom surface of the annular recess 38 of the sleeve 28.

Thus, engagement of the annular recess 38 of the cap element 16 with the annular projection 10 of the bottle 12, prevents disengagement of the plug 14 from the bottle 12 to the same extent as the conventional wire and metallic cap.

To open the bottle, i.e. to disengage the plug 14 from the bottle 12, the cap 16 is broken along the second precut line 36 on the skirt 28, e.g. by manually cutting along precut line 32 with a knife, and, subsequently, in the same manner, the cap is separated along the first cut line 32 of the skirt 28. When broken along the precut lines 32 and 36 in the above-described manner, the skirt 28, fitted over the annular projection 10 of the bottle 12 is severed across recess 38 and is thereby removed from the projection 10. As a result, the plug 14 is then ready to be removed from the bottle 12. Then, when the cap 16 is lifted by a user's finger, e.g., his thumb, and thereby removed from the bottle 12, the plug 14, held in close contact with the cap 16, can be removed from the bottle 12 together with the cap 16.

Figure 5:
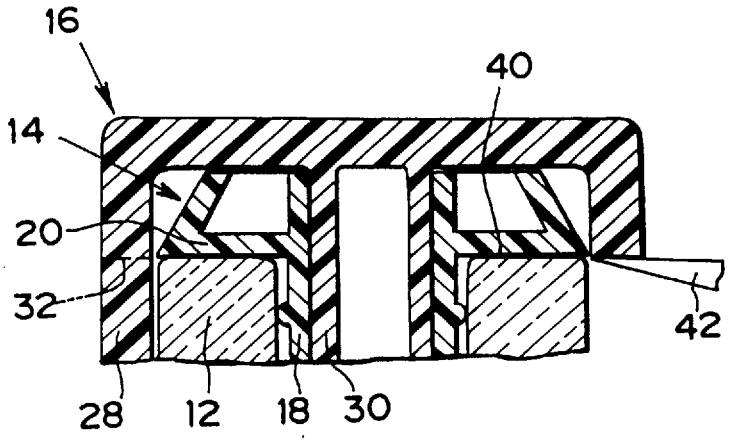
FIG. 5 is a vertical cross-sectional view of the closure showing a preferred location for a precut line.

While the position of the first precut in the sleeve 28 may vary, it is preferred that the position of the first precut line 32 be coplanar with the line of contact between the top of the head portion 20 of the plug 14 and the uppermost end 40 of the bottle 12 as shown in FIG. 5. This makes it easy to insert the blade of a knife 42 or the like into the first precut line 32 to sever the cap 16 and to remove the plug 14 from the bottle 12.

While the foregoing embodiment has been described as a closure and bottle containing a liquid with dissolved dioxide carbon gas, e.g. a champagne or the like, the present invention is not limited to bottles containing such a beverage. However, the invention is well suited to bottles containing such beverages.

A second embodiment of the present invention will now be described with reference to FIG. 6. In this second embodiment, in contrast to the annular projection 10 on the bottle 12 which serves as first engaging means in the embodiment of FIG. 1, an annular recess 46 is formed in the neck of bottle 44 to serve as the first engaging means and an annular projection 52 is formed on the inside of the skirt 50 of a flexible cap 48 molded of a synthetic 14 resin to serve as second engaging means by mating with recess 46. The cap 48, as viewed from the front side, has the same contour as that shown in FIG. 4.

Here, the cap 48 cannot be removed from the bottle 44 regardless of how powerfully a user makes the effort, owing to engagement of the upper edge of the annular projection 52 with the upper edge of the annular recess 46. In other words, the recess 46 and the annular projection 52 of the embodiment shown in FIG. 6 are dimensioned and structured to resist manual disengagement of the cap 48 from the bottle 44 simply by pulling.

A third embodiment of the present invention will now be described with reference to FIG. 7. In this embodiment, as in the previous embodiments, a cap 54 is made of a flexible synthetic resin. The cap 54 includes a plate-like top head portion 56, and an annular portion 58 in parallel with and spaced from the head top portion 56 to serve as second engaging means. A plurality of joinder arms 60 connect the head top portion 56 to the annular portion 58. This cap 54 is designed to fit a bottle 12 (as shown in FIG. 1) having an annular projection 10 formed around the outer circumference of its neck, near its mouth. The inner diameter of the annular portion 58 serving as second engaging means is dimensioned to be smaller than the outer diameter of the annular protrusion 10 serving as first engaging means.

A cylindrical portion 62 extends perpendicular from the center of the head top portion 56, concentric with annular portion 58 and is received in the previously described cylindrical portion 18 of the plug 14.

The annular portion 58 serving as second engaging means when the cap 54 is fitted onto the bottle 12 locks into a position below the annular projection 10 of the bottle 12 and, therefore, the cap 48 cannot be removed from the bottle 12 when a user makes an effort to disengage the cap 45 from the bottle 1 by hand without first breaking annular portion 58 along a precut line or lines 66.

A tab 64 extends from the annular portion 58 and is formed integral therewith. A precut line 66 extending across the annular portion 58 is provided at a position in the vicinity of the tab 64. Alternatively, two precut lines 66 may be formed on opposite sides of the tab 64 as shown in FIG. 7.

To disengage the plug 14 from the bottle 12, the precut line 16 is broken by manually pulling the tab 64 toward the top head portion 56. The cap 54 may then be lifted off of the bottle 12 and retains the plug 14 as it is disengaged from the bottle 12, with the result that the plug 14 is also disengaged from the bottle 12. Thus, the plug 14 fitted to the cap 54 can be disengaged from the bottle 12 together with the cap 54.

Figure 6:
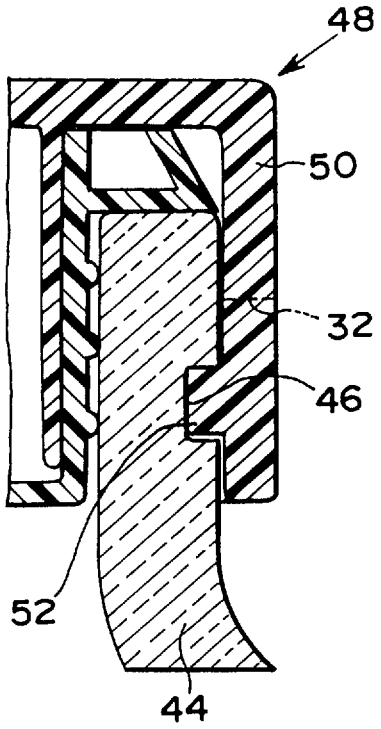
FIG. 6 is a fragmentary cross-sectional view of a closure in accordance with a second embodiment of the invention.
Figure 8:
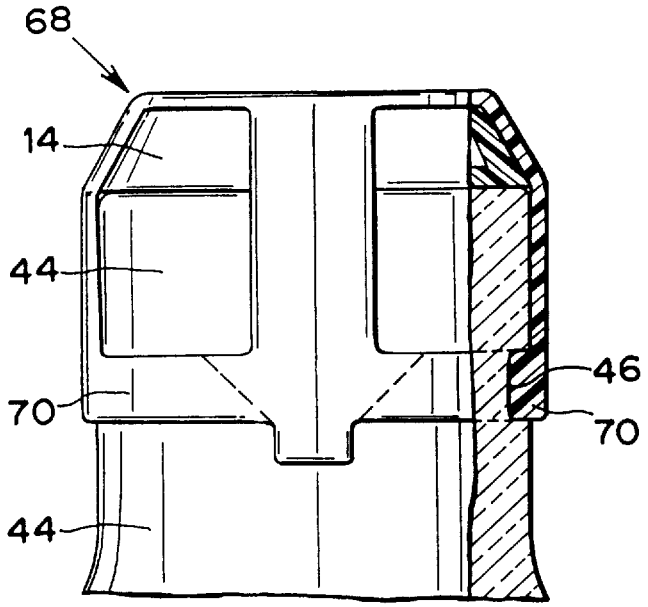
FIG. 8 is a side view, partially in cross-section, of a fourth preferred embodiment of the present invention.

In the fourth embodiment shown in FIG. 8, the closure is designed to seal a bottle 44 having an annular recess 46 formed thereon as first engaging means, similar to the bottle 44 as shown in FIG. 6. Cap 68 of this fourth embodiment is also molded of a deformable synthetic resin and includes an annular portion 70 serving as second engaging means, with the annular portion 70 fitting into the annular recess 46.

With this construction, since the upper edge of the annular portion 70 of the cap 68 engages the upper edge of the annular recess 46, as in the previous embodiments the cap 68 can not be manually removed from the bottle 14 by a user, without first breaking through precut line(s) 66.

Figure 7:
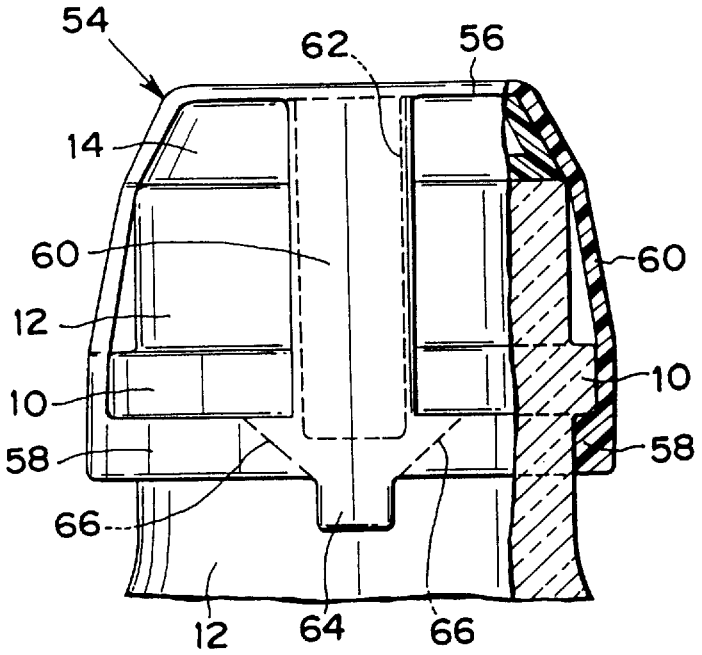
FIG. 7 is a side view, partially in cross-section, of a closure in accordance with a third preferred embodiment of the present invention.

As will be apparent from the above description, the closure shown in FIG. 7 corresponds to the closure shown in FIG. 1 and the closure shown in FIG. 8 corresponds to the closure of FIG. 6.

In all of the embodiments described above, the mouth of a bottle is sealed with a plug, with a first engaging means on the bottle engaging with a second engaging means on a cap which covers both the plug and the mouth. The cap can not be disengaged from the bottle either by pressure developed in the bottle or by a user making an effort to disengage the cap from the bottle by hand, unless the cap is first broken along a precut line. Accordingly, the closure of the present invention obviates any need for a wire or a metallic cap to close a bottle containing a wine such as a champagne or the like with the conventional device, and moreover, because there is no need for a wire fitting operation, the manufacturing cost is reduced. In addition, there is no danger that a user's finger might be injured in removing a wire or metallic cap from the bottle.

In addition, according to the present invention, since the closure elements are fabricated of a flexible synthetic resin and because the cap and plug elements have mating hollow cylindrical portions capable of deformation upon assembly with the plug fitted into the bottle, dimensional errors in the inner diameter of the bottle and outer diameter of the plug can be compensated for in forming a seal.

Additionally, according to the present invention, the cap can be fixed over the plug with enhanced force, and the plug can be disengaged simultaneously when the cap is disengaged from the bottle.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A closure device for sealing closed the mouth of a bottle having an annular structure around the circumference of its neck, adjacent the mouth, said closure device comprising:

a plug element for sealing closed the mouth of the bottle, said plug element including a plug cylindrical portion for forming a seal with the inner surface of the neck of the bottle when inserted through the mouth of the bottle and a head portion from which said plug cylindrical portion depends and wherein said plug cylindrical portion is molded from a flexible synthetic resin and is hollow, having a closed distal end and a hollow interior opening through said head portion; and a cap element for fitting over said plug element and the mouth of the bottle, said cap element including a top portion and a skirt portion extending from said top portion to a distal end edge, said skirt portion including engaging means for engaging the annular structure on the bottle to lock said plug within the mouth of the bottle and a first precut tear line extending across said engaging means and facilitating breaking of said engaging means for opening the bottle, said cap element further including a cap cylindrical portion concentric with said skirt for insertion into said plug cylindrical portion and for forming a seal therewith.

2. A closure device according to claim 1, wherein said engaging means on said skirt is an annular recess for engaging the annular structure on the bottle in the form of an annular protrusion.

3. A closure device according to claim 1, wherein said engaging means on said skirt is an annular protrusion for engaging the annular structure on the bottle in the form of an annular recess.

4. A closure device according to claim 1, wherein said skirt further includes a second precut tear line extending around the circumference of said skirt between said engaging means and said top portion, said first precut tear line extending between said second precut tear line and said distal end edge.

5. A closure device according to claim 4 wherein said head portion of said plug element defines an annular surface surrounding said plug cylindrical portion for fitting flush against the top of the bottle, said second precut line being coplanar with said annular surface with said closure device positioned to close the bottle.

6. A closure device according to claim 1, wherein a plurality of annular protrusions are formed on the exterior of the plug cylindrical portion for sealing with the interior surface of the neck of the bottle.

7. A closure device according to claim 1, wherein said cap cylindrical portion is hollow and has an open distal end which fits into said plug cylindrical portion.

8. A sealed beverage bottle, said bottle having a neck terminating at a mouth sealed closed by a closure device and first engaging means on said neck for locking with second engaging means on said closure device, said closure device comprising:

a plug element for sealing closed said mouth of said bottle, said plug element including a plug cylindrical portion mounted within said neck of said bottle and forming a seal with the inner surface of said neck of said bottle and a head portion from which said plug cylindrical portion depends and wherein said plug cylindrical portion is molded from a flexible synthetic resin and is hollow, having a closed distal end and a hollow interior opening through said head portion; and a cap element fitted over said plug element and said mouth of said bottle, said cap element including a top portion and a skirt portion extending from said top portion to a distal end edge, said skirt portion including said second engaging means, a first precut tear line extending across said second engaging means and facilitating breaking of said second engaging means for opening said bottle, said cap element further including a cap cylindrical portion concentric with said skirt for insertion into said plug cylindrical portion and for forming a seal therewith.

9. A sealed beverage bottle according to claim 8, wherein said second engaging means formed on said skirt is an annular recess and said first engaging means on said bottle is an annular protrusion.

10. A sealed beverage bottle according to claim 8, wherein said second engaging means on said skirt is an annular protrusion for engaging said first engaging means in the form of an annular recess.

11. A sealed beverage bottle according to claim 8, wherein said skirt further includes a second precut tear line extending around the circumference of said skirt between said second engaging means and said top portion, said first precut tear line extending between said second precut tear line and said distal end edge.

12. A sealed beverage bottle according to claim 11 wherein said head portion of said plug element defines an annular surface surrounding said plug cylindrical portion for fitting flush against said mouth of the bottle, said second precut line being coplanar with said annular surface.

13. A sealed beverage bottle closure device according to claim 8, wherein a plurality of annular protrusions are formed on the exterior of the plug cylindrical portion for sealing with the interior surface of said neck of said bottle.

14. A sealed beverage bottle according to claim 8, wherein said cap cylindrical portion is hollow and has an open distal end which fits into said plug cylindrical portion.

* * * * *

UNITED STATES PATENT AND TRADEMARK OFFICE

CERTIFICATE OF CORRECTION

PATENT NO. : 5,857,580
DATED : January 12, 1999
INVENTOR(S) : Tsuguo IIDAKA

It is certified that error appears in the above-identified patent and that said Letters Patent is hereby corrected as shown below:

On the title page; Under the Heading, "U.S. Patent Documents", please insert the following:

| | | | |
|---|---|---|---|
| --2,886,198 | 05/59 | Herter..... | 215/250 X |
| 3,099,361 | 07/63 | Ruetz..... | 215/345 |
| 3,120,900 | 02/64 | Faulstich..... | 215/256 |
| 3,191,790 | 06/65 | Coven et al..... | 215/254 X |
| 3,920,141 | 11/75 | Bojardi..... | 215/251 |
| 3,946,891 | 03/76 | Picoy et al..... | 215/256 |
| 3,995,762 | 12/76 | Pfefferkorn et al... | 215/256 |
| 4,081,720 | 03/78 | Pfefferkorn et al... | 215/354 |
| 4,303,167 | 12/81 | Martinez..... | 215/256 |
| 4,401,226 | 08/83 | Brown..... | 215/250 |
| 5,224,616 | 07/93 | Crisci..... | 215/256 |

UNITED STATES PATENT AND TRADEMARK OFFICE

CERTIFICATE OF CORRECTION

PATENT NO. : 5,857,580

DATED : January 12, 1999

INVENTOR(S) : Tsuguo IIDAKA

It is certified that error appears in the above-identified patent and that said Letters Patent is hereby corrected as shown below: On the title page;

FOREIGN PATENT DOCUMENTS 1 915 356 10/70 Germany 4 016 592 05/91 Germany--.

Signed and Sealed this

Fourteenth Day of December, 1999

*Attest:*

*Attesting Officer*

Q. TODD DICKINSON

*Acting Commissioner of Patents and Trademarks*